United States Patent [19]

Walter

[11] Patent Number: 4,881,708

[45] Date of Patent: Nov. 21, 1989

[54] SHELF FOR DISPLAYING ARTICLES

[75] Inventor: Herbert Walter, Müllheim, Fed. Rep. of Germany

[73] Assignee: Protoned B.V., Amsterdam, Netherlands

[21] Appl. No.: 122,356

[22] Filed: Nov. 18, 1987

[30] Foreign Application Priority Data

Nov. 19, 1986 [CH] Switzerland ..... 4622/86-2

[51] Int. Cl.[4] ..... A47H 29/02

[52] U.S. Cl. ..... 248/243; 108/108; 211/153

[58] Field of Search ..... 248/235, 243, 250; 211/134, 135, 153, 90; 108/108, 111; 312/270

[56] References Cited

U.S. PATENT DOCUMENTS

| | | | |
|---|---|---|---|
| 3,225,937 | 12/1965 | Amthor | 211/153 X |
| 3,602,159 | 8/1971 | Marschak | 211/153 X |
| 4,148,263 | 4/1979 | Suttles | 108/111 X |
| 4,603,782 | 8/1986 | Fenwick | 108/107 X |
| 4,729,613 | 3/1988 | Tromble | 312/270 |

FOREIGN PATENT DOCUMENTS

| | | | |
|---|---|---|---|
| 1429535 | 5/1969 | Fed. Rep. of Germany | 211/153 |
| 504314 | 4/1939 | United Kingdom | 211/153 |
| 956091 | 4/1964 | United Kingdom | 211/153 |

*Primary Examiner*—J. Franklin Foss
*Attorney, Agent, or Firm*—Ralph W. Selitto, Jr.

[57] ABSTRACT

The shelf is constructed, so that it can easily be dismantled, from a frame which can be suspended on a supporting device (1) and which consists of a pair of lateral brackets (3, 3') and of a front and a rear longitudinal member (4, 5), and from a resting surface releasable from the frame. The brackets and longitudinal members are connected to one another, to form a torsion-resistant constructional part, and can be equipped with selectively usable resting surfaces, to make it possible to satisfy changing requirements as regards the display of articles at a very low outlay in terms of assembly time, stockkeeping and investment.

19 Claims, 4 Drawing Sheets

Figure 7:
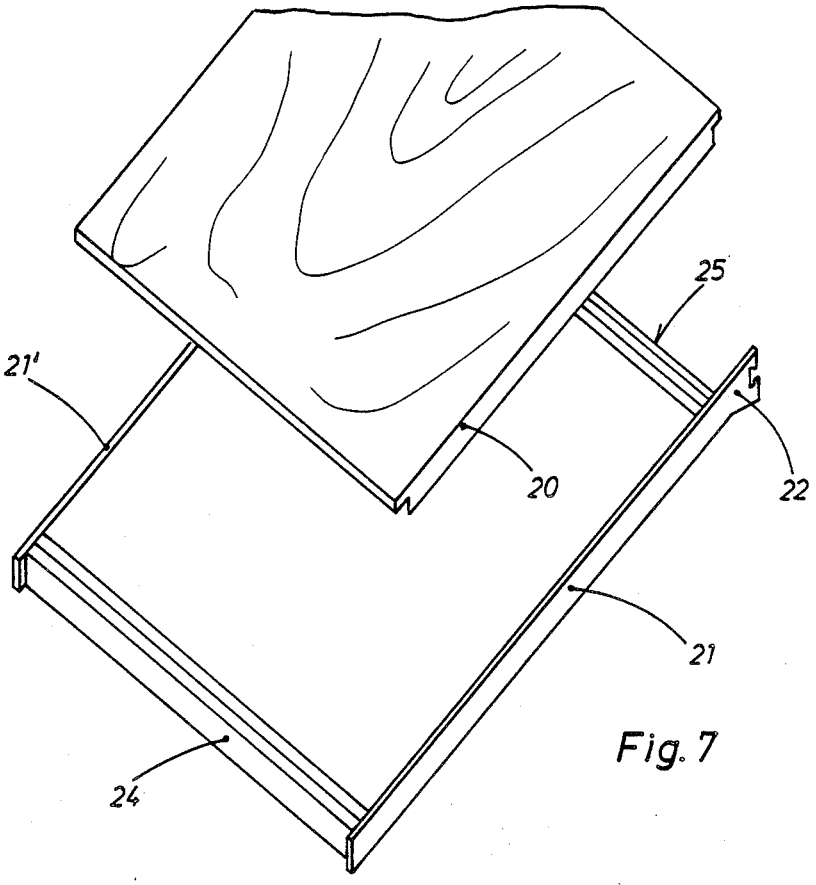

Fig. 1
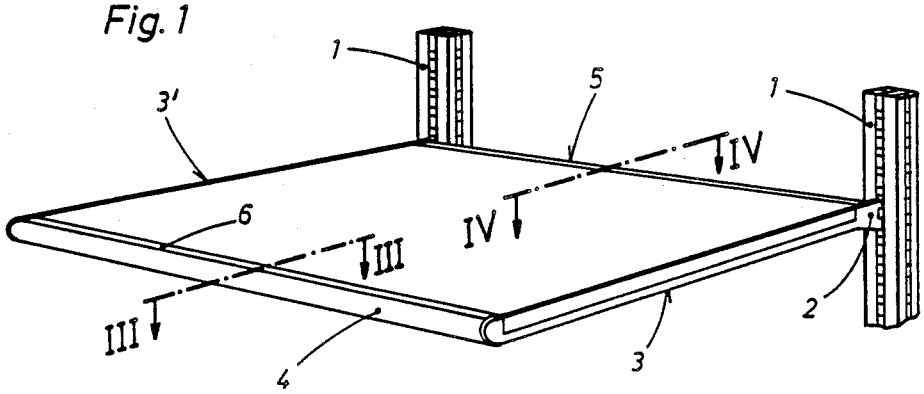
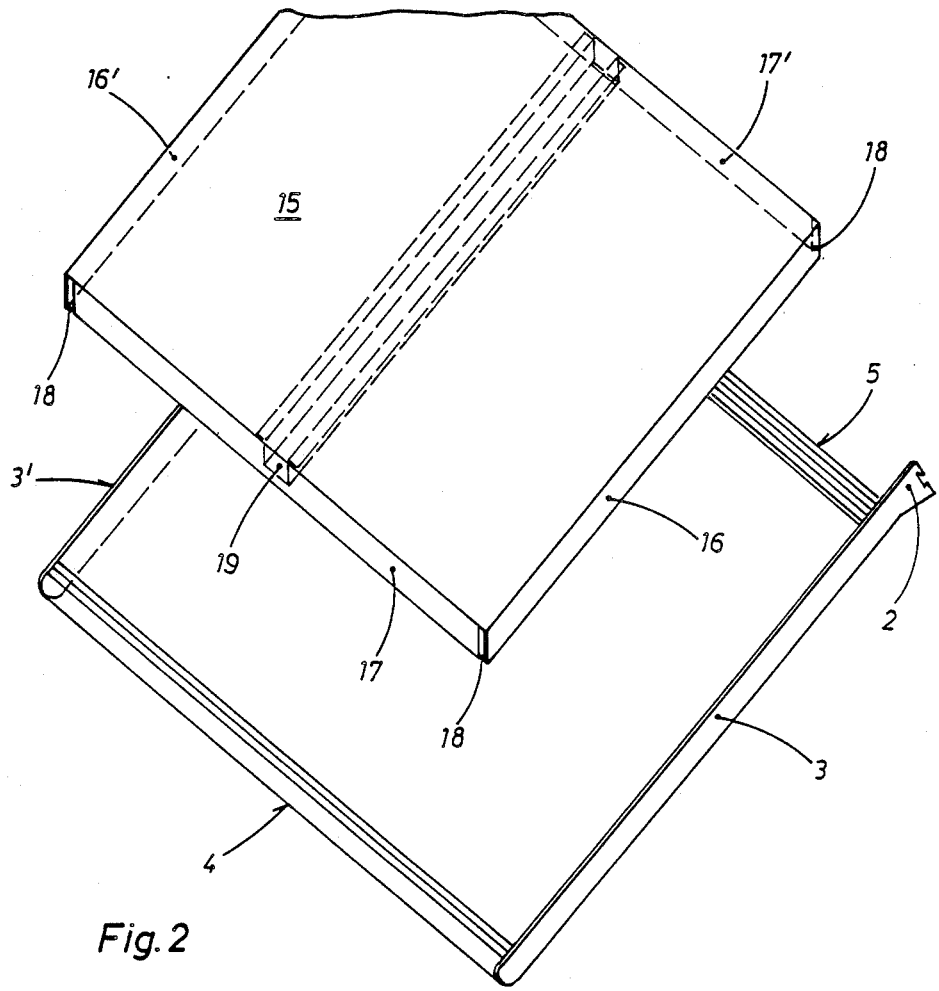
Fig. 2

Fig.3
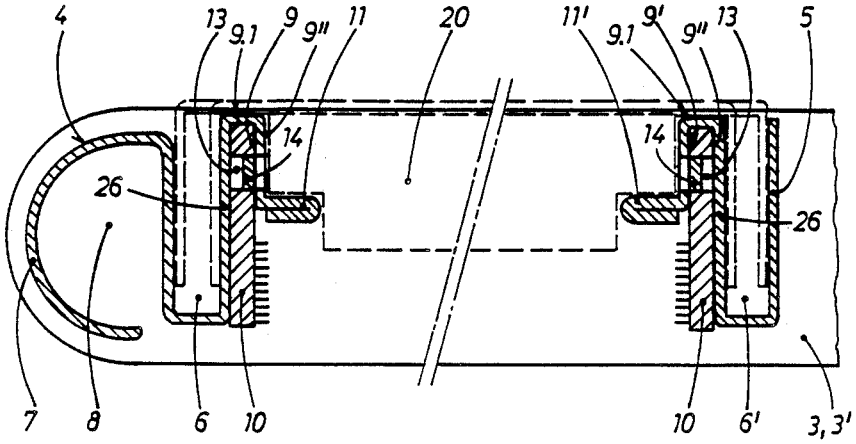
Fig.4
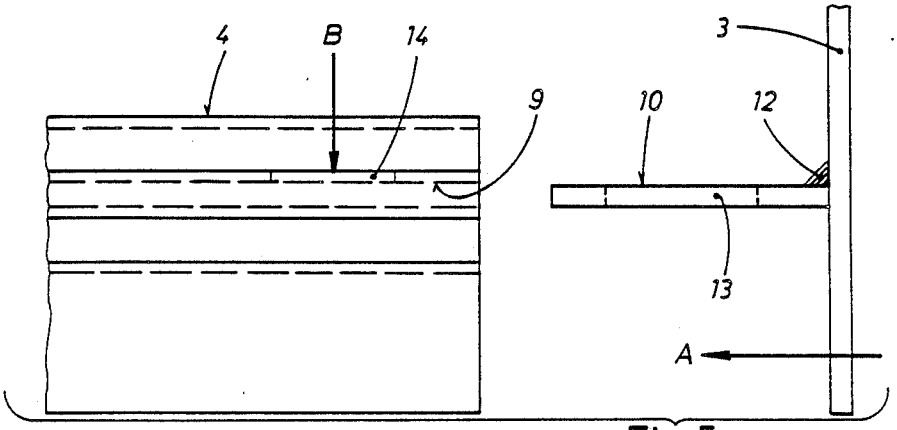
Fig.5c
Fig.5a
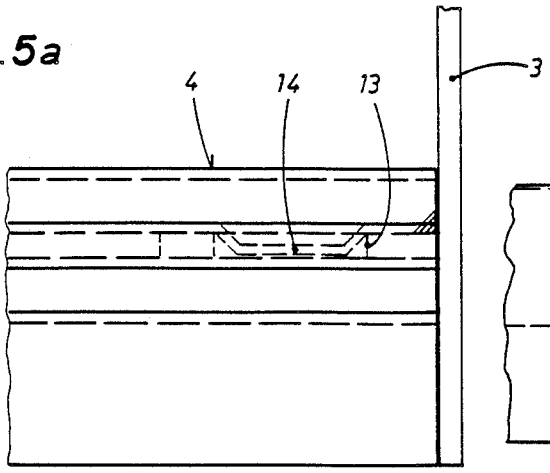
Fig.5b
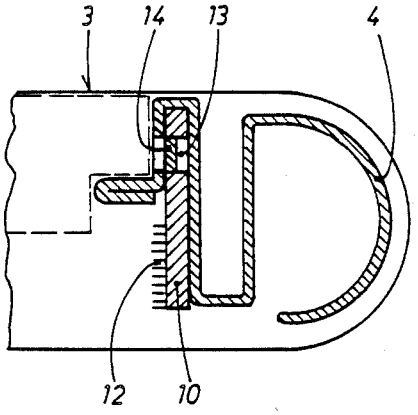

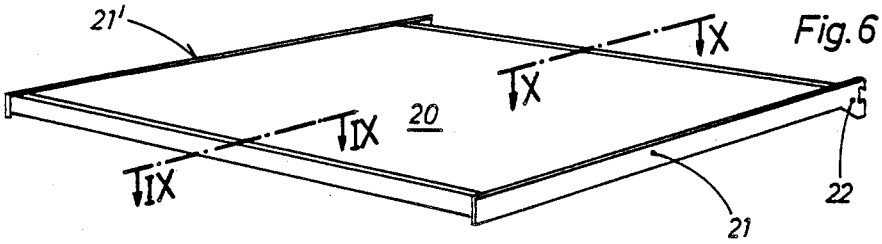
Fig. 6
Fig. 9
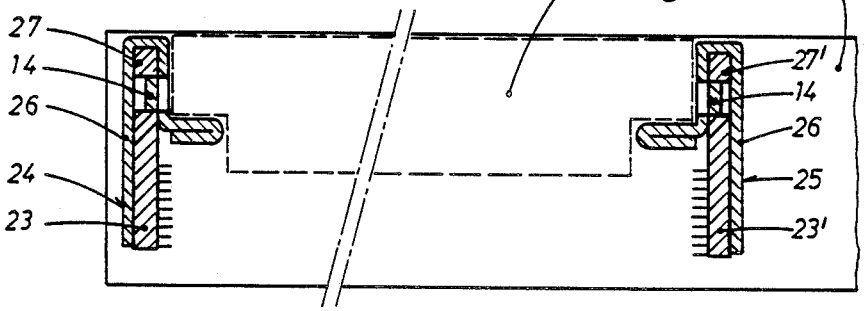
Fig. 10
Fig. 11
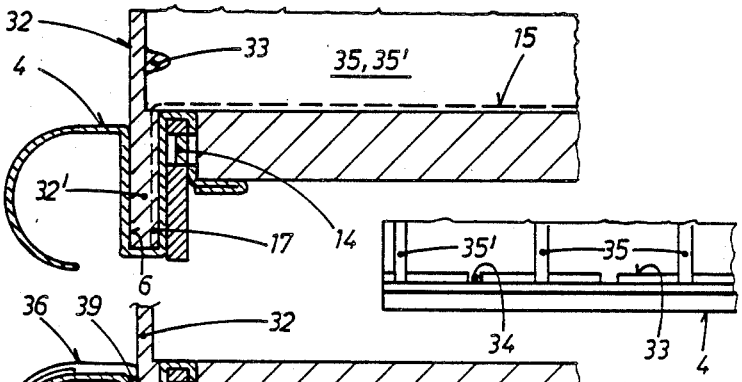
Fig. 12
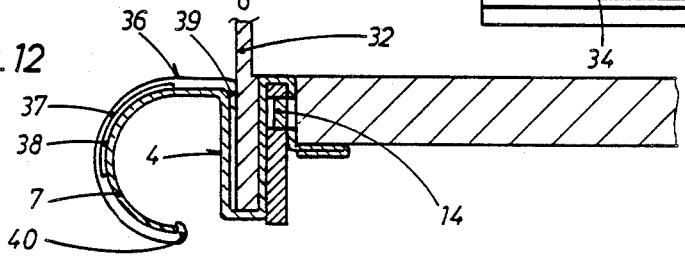
Fig. 13
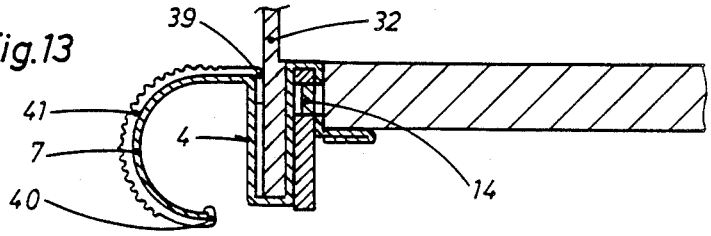

SHELF FOR DISPLAYING ARTICLES

In sales rooms and showrooms, the object is to make it possible to present articles so as to display them as effectively as possible. For this, not only appropriately designed supporting surfaces at a suitable presentation height are important, but also their surface size, so that the article to be displayed can be presented or demonstrated to advantage in terms of its practical use. To avoid the need to have a large stock of furniture available for this purpose, there is the problem of adapting the necessary display surfaces to changing display requirements so as to involve only a low outlay in terms of time and material. At the same time, in the stockkeeping of parts, on the one hand it should be possible to achieve aims, such as minimum capital investment and a low space requirement, and on the other hand there should be a wide variety in design as regards color and material.

The set object arising from this is directed at a shelf for displaying articles, which is based on a construction obtainable on the modular principle, but in which there should be individual basic components only in so far as requirements of a small amount of time for changes of equipment and minimum capital investment can still be satisfied.

The manner according to the invention of achieving this object is defined by the characterizing features of patent claim 1. Embodiments thereof are defined in the dependent claims.

The advantages of the shelf according to the invention are, on the one hand, that it can be built into or onto a wall or a free-standing column-type supporting structure easily. Its main parts are a shelf rest and a frame structure which can be produced from clearly designed supporting members for the shelf surface and the parts of which are, for example, elements which can be stamped and bent from sheet-like material. The frame structure can be designed as a torsion-resistant cantilever element which is executed to standard dimensions and which can be anchored in a wall-mounted or column-type supporting structure by means of bracket members. The materials which can be used as shelf surfaces are virtually all sheet-like materials which can be subjected to useful loads and in or on which surface-dividing elements can also be fastened.

Figure 8:
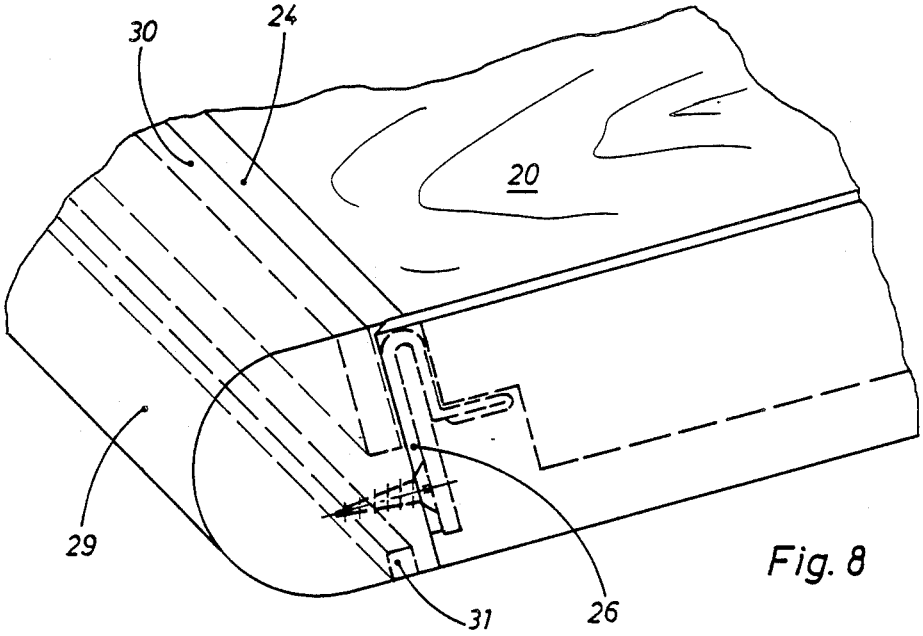

Exemplary embodiments of the subject of the invention and detailed designs of its components are described below with reference to the drawing. In the drawing:

FIG. 1 shows, in a perspective representation, a shelf of the type according to the invention with a sheet-metal rest on a column-type supporting structure, FIG. 2 shows the frame structure and the sheet-metal rest of the shelf according to FIG. 1 in an exploded perspective representation, FIGS. 3 and 4 show sections through the front and rear longitudinal members of the frame along the lines III—III and IV—IV in FIG. 1, FIGS. 5*a* to 5*c* show the design of the connection region between a bracket and a longitudinal member of the frame in horizontal projection (a), in section (b) and exploded (c), FIG. 6 shows, in a perspective representation, a shelf of the type according to the invention with a wood or glass (plexiglass) insert, FIG. 7 shows the frame structure and wood insert of the shelf according to FIG. 6 in an exploded representation, FIG. 8 shows a partial representation of an alternative version of the shelf with a wood insert on a larger scale, FIGS. 9 and 10 show sections through the longitudinal members of the frame along the lines IX—IX and X—X in FIG. 6, FIG. 11 shows the longitudinal member of the frame according to FIG. 3 with a longitudinal retention means for lateral and transverse limitations and subdivisions of the shelf surface in cross-section and in a cut-out horizontal projection on a smaller scale, FIG. 12 shows, in cross-section, the longitudinal member of the frame according to FIG. 3 with a label-covering rail, and FIG. 13 shows, in cross-section, the longitudinal member of the frame according to FIG. 3 with a sectional front-edge cover bar.

In FIG. 1, 1 denotes columns of a free-standing supporting structure or suspension rails set in a wall, which are equipped with anchoring parts (not shown) for the vibration-proof suspension of the connection head 2 of a bracket 3. The connection head 2 is appropriately connected integrally to the bracket 3, 3', and at least its outer face is in the same plane as the outer face of the bracket. As is evident particularly from FIG. 2 and as can be derived from FIGS. 3 to 5, a shelf is limited on each side by a bracket 3, 3'. The two brackets 3, 3' are connected to one another by means of a front and a rear longitudinal member 4, 5, the length of which corresponds to a standard dimension predetermined by the distance between the columns 1, 1. The cross-sections of the two longitudinal members 4 and 5 are shown in FIGS. 3 and 4 in sections along the lines III—III and IV—IV according to FIG. 1. The longitudinal member 4 contains, on the left of or at the front of an upwardly open insertion groove 6 of U-shaped profile, a front-edge closure 7 which is formed on this and which, as shown, limits an approximately semi-circular channel 8 open at the bottom. Of course, this channel can also have a different cross-sectional shape and, for example, be rectangular or square. Its outer contour can appropriately be designed as a carrier for a label-covering rail (FIG. 12) or for a sectional cover bar (FIG. 13). Adjacent to the insertion groove 6 on the right is first a face 9.1, on which a shelf surface can be placed, as described later, and then a downwardly open assembly pocket 9 which is likewise of U-shaped profile and which serves for receiving an assembly web 10 described below. The inner closure of the shelf is formed by a supporting flange 11 formed on the outer wall 9' of the assembly pocket 9 and directed rectangularly/horizontally inwards. The longitudinal member 4 is shown as a bending section bent several times from sheet metal, but can also be produced from an extruded sectional bar.

The rear longitudinal member 5, as regards the insertion groove 6', the assembly pocket 9' and the supporting flange 11', is shown designed as a mirror image of the front longitudinal member in terms of the corresponding portions.

The right-hand bracket 3 is coupled to the front longitudinal member 4 in the way shown in three representations in FIG. 5, by means of an assembly web 10 connected firmly to the bracket member "on the inside". It may be noted, here, that a corresponding assembly web 10 is also provided for the connection of the rear longitudinal member 5 to the right-hand bracket 3. The longitudinal member 5 is connected to the bracket 3 accordingly and by the same means as those by which the front longitudinal member 4 is connected to the bracket 3. The same applies to the connection of the two longitudinal members 4, 5 to the left-hand bracket 3' by means of identical inward-projecting assembly webs, as a mirror image of the representation according to FIG. 5. This connection is therefore not described specially.

FIG. 5 (*b, c*) shows the arrangement of the assembly web 10 as a supplement to FIGS. 3 and 4. The web 10 is fastened to the bracket 3 (3') near the front (or rear) end of the latter, in such a way that when the longitudinal member is attached to the bracket a fit virtually free of gaps can be obtained. Accordingly, the welding seam 12 connecting the assembly webs 10 to the brackets 3, 3' is placed at a point located outside the sectional portions of the longitudinal members. In the example shown, one is located in the region underneath the supporting flange 11. It is thus possible to separate the longitudinal members from bar stock in a simple way without reworking and end notches and consequently ensure efficient production.

The longitudinal member 4 is then attached to the assembly web 10 so that the latter rests on the assembly pocket 9 under clamping engagement. Alternatively, the assembly web 10 can be pressed into the assembly pocket 9 sideways in the direction of the arrow A. To secure this clamping engagement, as is necessary to obtain a torsion-resistant frame structure, the assembly web 10 is equipped with a slot 13 which extends longitudinally on this and into which engages a detent member 14 which can be mortised into the slot from the inner wall 9'' of the assembly pocket 9 (arrow B). This detent member can be, for example, a tongue element or strip element which is made movable in the pocket wall as a result of a notching cut and which is virtually invisible from outside and can easily be pressed into the slot 13.

Frame structures designed in this way can be stacked in a space-saving manner and can be supplied in dimensions, of which only the width is predetermined by the distance between the columns 1. The frames can be formed by shelf rests and be made of wood or similar load-bearing sheet-like materials resting on the supporting flanges 11, 11' or of metal in the form of sheet-metal rests which, according to FIG. 1, are carried laterally by the top sides of the brackets 3, 3'. Such a sheet-metal rest is shown in FIG. 2 as a component in the form of an inverted tray, with a continuous resting surface 15. The rectangularly bent side limitations 16, 16' engage over the outer faces of the brackets 3, 3', whilst the front and rear walls 17 and 17' engage into the insertion grooves 6, 6' (FIGS. 3 and 4). This engagement is possible on the inner or on the outer insertion-groove wall, depending on the way in which the insertion grooves 6, 6' are used. For this, see the broken lines in FIGS. 3 and 4. In the latter case, the depth of the sheet-metal rest must be made larger by an amount corresponding to the cumulative width of the two insertion grooves 6, 6' than when the insertion grooves are free. The front and rear walls 17, 17' are provided with corner notches 18 for the brackets 3, 3' which are continuous at these points. One or more reinforcing elements 19 arranged on the underside of the resting surface 15 ensure a resting surface 15 which is plane under all typical loads.

Before a discussion of the possibilities of extending the shelf according to the invention, which are afforded by the design of the above-described longitudinal members 4 and 5, attention will be drawn to a simpler shelf embodiment illustrated in FIGS. 6 to 10. This embodiment is suitable for shelf rests 20 preferably made of wood, glass or plexiglass and for relatively low bearing loads.

According to FIGS. 9 and 10, the brackets 21, 21', of the same basic design as in the first exemplary embodiment and each with a connection head 22, are equipped with assembly webs 23, 23' directed sideways and inwards. FIG. 7, in a representation similar to that of FIG. 2, shows a frame structure composed of the brackets 21, 21' and of longitudinal members 24 (at the front or on the front side) and 25 (at the rear or on the rear side) connected to them. The longitudinal members 24, 25 illustrated in detail in FIGS. 9 and 10 are shown as sheet-metal sections of the same profile and are arranged in the frame structure as a mirror image of one another. They contain, on the inside of an outer leg 26, an assembly pocket 27, 27' similar to the assembly pockets 9, 9' in FIGS. 3 and 4, for receiving the assembly webs 23, 23' with a clamping effect. Adjacent to each of these at right angles and in a horizontal direction is a supporting flange 28, 28' which is similar to the supporting flanges 11, 11' in FIGS. 3 and 4 and on which the shelf rest 20 is supported. The vibration-proof connection between the longitudinal members 24, 25 and the brackets 21, 21' can be made in basically the same way as described in relation to the combination of the slot 13 and detent member 14 of FIGS. 3 and 4.

As shown in FIG. 8, the front longitudinal member 24 can be equipped with a front-edge closing bar 29 which is connected to the longitudinal member 24, for example by being screwed to the outer leg 26. The front-edge closing bar 29 can be of any profile and be made of wood, plastic or another material and, moreover, can be provided with an insertion groove 30 indicated by broken lines, which can perform the function of the insertion groove 6 in the longitudinal member 4 (FIG. 3). Furthermore, if anchoring slits 30, 31 are made, the front-edge closing bar 29 can be designed so that, in such an embodiment too, covering elements described later with reference to FIGS. 12 and 13 and in the form of a label-covering rail 36 or a sectional cover bar 41 can be attached. It emerges from this that the embodiment of the shelf according to FIG. 6 can also subsequently be supplemented at least partially with accessories approximately the same as those described in the first exemplary embodiment.

FIG. 11 shows, in a vertical section, a closing wall 32 inserted into the insertion groove 6 in a front longitudinal member 4. Formed on the inner face of this closing wall are two or more longitudinal ribs 33, in which insertion recesses 34 are made, in turn, for receiving transverse or longitudinal dividing elements 35 or side limitations 35'. The lower end of the closing wall 32 has a thickened portion 32' which, relative to the insertion groove 6, forms a space-filling base portion. The wall thickness of this portion can be selected so that, for example, together with the end wall 17 of a resting surface 15, represented by a broken line, and/or together with further wall-forming elements, it fills the groove space. The detail shown in a horizontal projection in FIG. 11 illustrates the insertion recesses 34 in the rib 33 as grooves which can be occupied selectively by longitudinal dividing elements 35 or a side limitation 35' made of glass or the like.

The front longitudinal frame member 4 as shown in FIG. 12 is equipped with a label-covering rail 36 which can be attached to the front-edge closure 7 over all or some of the length of the latter. The portion of the label-covering rail 36 surrounding the rounded front edge (or a differently shaped surface portion if another member profile is chosen) can be equipped with a transparent panel 37, the back of which (limits a shallow longitudinal cavity 38 for receiving a label strip. An upper and a lower hooked comb 39, 40 serve for retaining the covering rail 36 on the longitudinal member 4 or on the front-edge closure 7.

Finally, FIG. 13 shows an embodiment of the longitudinal frame member 4, to the front-edge closure 7 of which is attached a sectional cover bar 41. This sectional cover bar is preferably extruded from a dimensionally stable plastic and has hooked combs 39, 40, similar to those of FIG. 12, for retaining it on the longitudinal member. The sectional cover bar can be designed both to impart a decorative effect and as edge protection against mechanical damage to the rounded closure (or closure having a different profile).

I claim:

1. A display shelf adapted to be removably attached to a supporting device, comprising an overhanging frame structure including a first bracket extending along one side of said frame structure, a second bracket extending along an opposite side of said frame structure, a first cross member extending between said first and second brackets adjacent one end of said frame structure, said first cross member having a first pocket formed integrally therewith, a first flange extending toward an opposite end of said frame structure from a first inner leg positioned on one side of said first pocket and a first outer leg positioned on an opposite side of said first pocket, a second cross member extending between said first and second brackets adjacent said opposite end of said frame structure, said second cross member having a second pocket formed integrally therewith, a second flange extending toward said one end of said frame structure from a second inner leg positioned on one side of said second pocket and a second outer leg positioned on an opposite side of said second pocket, first supporting means for supporting said first cross member between said first and second brackets, said first supporting means including a first support member attached to said first bracket at a point located underneath said first flange and extending from said first bracket toward said second bracket, said first support member being received within said first pocket such that said first cross member is in bearing and clamping engagement with said first support member, which is substantially covered by said first outer leg, and a second support member attached to said second bracket at a point located underneath said first flange and extending from said second bracket toward said first bracket, said second support member being received within said first pocket such that said first cross member is in bearing and clamping engagement with said second support member, which is substantially covered by said first outer leg, and second supporting means for supporting said second cross member between said first and second brackets, said second supporting means including a third support member attached to said first bracket at a point located underneath said second flange and extending from said first bracket toward said second bracket, said third support member being received within said second pocket such that said second cross member is in bearing and clamping engagement with said third support member, which is substantially covered by said second outer leg, and a fourth support member attached to said second bracket at a point located underneath said second flange and extending from said second bracket toward said first bracket, said fourth support member being received within said second pocket such that said second cross member is in bearing and clamping engagement with said fourth support member, which is substantially covered by said second outer leg, and a shelf rest element releasably supported on said frame structure by said first and second flanges.

2. A display shelf according to claim 1, wherein said first cross member further includes an upwardly open groove sized and shaped so as to receive a closing wall which projects upwardly beyond said shelf rest element, said first outer leg of said first cross member delimiting one side of said groove.

3. A display shelf according to claim 2, wherein said closing wall has an inner surface provided with a plurality of ribs which are spaced apart so as to define a plurality of recesses therebetween.

4. A display shelf according to claim 3, wherein each of said recesses is sized and shaped so as to releasably receive a partition member, whereby an area above said shelf rest element may be partitioned.

5. A display shelf according to claim 1, wherein said first and second brackets are made out of flat material.

6. A display shelf according to claim 1, wherein said first cross member further includes a first upwardly open groove sized and shaped so as to receive a first end wall depending from one end of said shelf rest element and wherein said second cross member further includes a second upwardly open groove sized and shaped so as to receive a second end wall depending from an opposite end of said shelf rest element.

7. A display shelf according to claim 6, wherein said first outer leg of said first cross member delimits one side of said first groove and wherein said second outer leg of said second cross member delimits one side of said second groove.

8. A display shelf according to claim 7, wherein an opposite side of said first groove of said first cross member is delimited by a first outer wall and wherein an opposite side of said second groove of said second cross member is delimited by a second outer wall.

9. A display shelf according to claim 8, wherein said first cross member further includes a closure member which extends outwardly from said first outer wall and which cooperates with said first outer wall to define a channel.

10. A display shelf according to claim 9, wherein said closure member includes a label-covering rail.

11. A display shelf according to claim 9, wherein said closure member includes a decorative cover bar.

12. A display shelf according to claim 9, wherein said closure member includes a protective cover bar.

13. A display shelf according to claim 6, wherein said shelf rest element further includes a first side wall depending from one side of said shelf rest element and extending over said first bracket and a second side wall depending from an opposite side of said shelf rest element and extending over said second bracket.

14. A display shelf according to claim 13, wherein said first end wall of said shelf rest element extends over said first outer leg of said first cross member and wherein said second end wall of said shelf rest element extends over said second outer leg of said second cross member.

15. A display shelf according to claim 14, wherein said shelf rest element is in the form of an inverted tray.

16. A display shelf according to claim 1, wherein said first cross member is attached to said first support member by a first notch-type joint which includes a first detent member bent out of said first inner leg of said first cross member and a first slot provided in said first support member and into which said first detent member is mortised and wherein said first cross member is attached to said second support member by a second notch-type joint which includes a second detent member bent out of said first inner leg of said first cross member and a second slot provided in said second support member and into which said second detent member is mortised.

17. A display shelf according to claim 16, wherein each of said first and second detent members is formed by a pair of stamping cuts made in said first inner leg of said first cross member.

18. A display shelf according to claim 17, wherein said second cross member is attached to said third support member by a third notch-type joint which includes a third detent member bent out of said second inner leg of said second cross member and a third slot provided in said third support member and into which said third detent member is mortised and wherein said second cross member is attached to said fourth support member by a fourth notch-type joint which includes a fourth detent member bent out of said second inner leg of said second cross member and a fourth slot provided in said fourth support member and into which said fourth detent member is mortised.

19. A display shelf according to claim 18, wherein each of said third and fourth detent members is formed by a pair of stamping cuts made in said second inner leg of said second cross member.

* * * * *